United States Patent [19]

Pruyne

[11] Patent Number: 4,982,746

[45] Date of Patent: Jan. 8, 1991

[54] DEVICE FOR SLOWING THE BURNING OF A RESTING CIGARETTE AND FOR EXTINGUISHING A CIGARETTE

[76] Inventor: Jerry R. Pruyne, 520 I St., Salt Lake City, Utah 84103

[21] Appl. No.: 361,443

[22] Filed: Jun. 5, 1989

[51] Int. Cl.[5] ..... A24F 13/18

[52] U.S. Cl. ..... 131/235.1; 131/241; 131/256

[58] Field of Search ..... 131/231, 235.1, 240.1, 131/256, 257, 241, 242

[56] References Cited

U.S. PATENT DOCUMENTS

| | | | |
|---|---|---|---|
| 2,111,172 | 3/1938 | Cook | 131/240.1 X |
| 2,715,961 | 8/1955 | Field | 131/235.1 |
| 2,764,165 | 9/1956 | Lincecum | 131/235.1 |
| 2,830,599 | 4/1958 | Hinson | 131/256 |
| 4,239,049 | 12/1980 | Perry | 131/240.1 |

FOREIGN PATENT DOCUMENTS

| | | | |
|---|---|---|---|
| 2262038 | 7/1973 | Fed. Rep. of Germany | 131/240.1 |
| 2386992 | 11/1978 | France | 131/235.1 |
| 2443810 | 7/1980 | France | 131/235.1 |
| 2594302 | 8/1987 | France | 131/256 |

*Primary Examiner*—V. Millin

*Assistant Examiner*—Jennifer L. Doyle

*Attorney, Agent, or Firm*—Mallinckrodt & Mallinckrodt

[57] ABSTRACT

A device for extinguishing a cigarette without damaging the cigarette thereby allowing the cigarette to be relit for continued smoking without the bad taste normally accompanying a relit cigarette includes an air compartment with an entrance into the compartment through which the lighted end of a cigarette is inserted. The compartment is configured so that upon insertion of the cigarette, a substantially closed air chamber is formed communicating with the end of the cigarette. The cigarette itself substantially blocks the entrance to the air chamber so that air flow into the chamber, other than through the cigarette itself, is substantially blocked. The air chamber is sized to provide enough air to support continued burning of the cigarette for a preset time, usually about five seconds, after insertion. The invention also includes a device for allowing the cigarette to continue to burn between drags on the cigarette but to reduce the smoke output and rate of burn. This includes a channel shaped to closely receive and cradle the burning end of a cigarette around at least a third of the circumference of the cigarette. An ash tray of the invention preferably includes both devices of the invention.

20 Claims, 2 Drawing Sheets

DEVICE FOR SLOWING THE BURNING OF A RESTING CIGARETTE AND FOR EXTINGUISHING A CIGARETTE

BACKGROUND OF THE INVENTION

1. Field

The invention is in the field of ash trays and devices for extinguishing cigarettes.

2. State of the Art

Ash trays in use today provide a receptical for ashes from cigarettes as they burn and for cigarette butts after smoking of the cigarette has been completed. Ash trays usually also provide a rest for cigarettes to hold the cigarette as it burns, when not being smoked, but when the smoker desires to keep it lit and available for smoking. If a cigarette is extinguished after having been partially smoked, the smoke that remains in the cigarette and cools taints the unburned tobacco and any filter material present so that the cigarette tastes badly if relit and the remaining part smoked.

With the current cost of cigaretts it would be desirable to be able to avoid wasted burning of the cigarette and with the current concern for reducing the smoke in the air that non-smokers breath, it would be desireable to reduce the amount of smoke released by a cigarette while not being smoked by a smoker, for example, the smoke released by a cigarette while resting in an ash tray between drags by a smoker.

SUMMARY OF THE INVENTION

According to the invention, it has been found that if the burning end of a cigarette is inserted into a chamber so as to substantially close the inflow of air into the chamber other than through the cigarette itself and wherein a preset amount of air remains in the chamber upon insertion of the burning end of a cigarette thereinto to allow the cigarette to continue burning for a time to cause an inflow of air into the cigarette from the nonburning end sufficient to substantially remove or reduce the smoke in the cigarette, the cigarette can be rapidly extinguished and can be relit when desired to continue smoking without the usual bad taste associated with a relit cigarette. This causes the fresh air washing of both the filter and unburned tobacco and allows a cigarette to be extinguished between drags which conserves the cigarette and reduces the amount of smoke released by the cigarette directly into the air. This also reduces the amount of nicotine otherwise inhaled by the user from a cigarette that has been burning in an ash tray.

In a preferred form of the invention, a compartment is formed by a tapered or cylindrical passage closed at one end, into which the cigarette may be inserted through the open end. The closed end of the passage or compartment has a stop for the cigarette to prevent the cigarette from abuting the end of the passage so that a chamber is formed between the cigarette and the end of the passage. The passage is configured so that its diameter at the resting position of the cigarette is approximately equal to the diameter of the cigarette to substantially block the flow of air around the outside of the cigarette into the chamber. The stop may conveniently take the form of a cone extending from the closed end of the passage toward the open end. The top of the cone contacts the end of the cigarette when inserted into the passage and holds it a preset distance from the end of the passage. The height of the cone is set to provide a minimum space in the chamber so that enough oxygen is in the air trapped in the chamber when closed by the cigarette to support the continued burning of the cigarette for a short time. It is believed that with the continued burning of the cigarette, it starts to draw air in from outside the chamber through the unburned end of the cigarette. This drives fresh air into and through the filter and unburned tobacco in the cigarette and washes the smoke from the unburned portion of the cigarette. However, the air drawn into the cigarette in this manner is not sufficient to keep the cigarette burning. It has been found that only about 5 seconds of continued burning is necessary to draw sufficient air into the cigarette to wash and remove the smoke or other material which provide a bad taste upon relighting. Thus, the air trapped in the chamber needs to be enough to keep the cigarette burning for only about 5 seconds. When the oxygen in the chamber is burned, the cigarette goes out almost immediately for lack of oxygen.

This aspect of the invention thus results in a very short burning time when a cigarette is placed into the compartment to thereby substantially reduce, and almost eliminate, smoke released to the atmosphere, and also allows the cigarette to be relit as many times as desired to thereby conserve cigarettes.

It has also been found that for longer burning of a cigarette in order to keep it burning between drags, but to slow the burning and reduce the smoke from such cigarette between drags, that the cigarette may be placed in a channel configured to fit closely about the outside of the cigarette for at least a third of the circumference of the cigarette, and preferably to extend about a half of the circumference of the cigarette. This reduces the air flow to the burning end of the cigarette as well as cooling the burning end to slow the burning and reduce smoke output. When placed in such a channel, the cigarette will continue to burn slowly for a short time before going out. The amount of burning time before going out depends on the extent to which the channel surrounds the cigarette and with a channel receiving and closely surrounding about one-half the cigarette, the cigarette will burn for somewhat over two minutes before going out. However, the burning is slowed sufficiently so that smoke output is cut by about 50% after about ten seconds in the channel and to about 90% after two minutes. Thus, if a smoker merely wishes to put the cigarette down for a short time (less than about 2 minutes) and to then pick it up and continue smoking, the channel can be used.

THE DRAWINGS

In the accompanying drawings, which show the best mode presently contemplated for carrying out the invention:

FIG. 1 is a perspective view of an ash tray incorporating both aspects of the invention;

FIG. 2, a vertical section taken on the line 2—2 of FIG. 1;

FIG. 3, a vertical section of an ash tray insert incorporating one of the aspects of the invention;

FIG. 4, a vertical section similar to FIG. 3, showing a second embodiment of an ash tray insert;

FIG. 5, a perspective view of a portable cigarette snuffer incorporating one aspect of the invention;

FIG. 6, a vertical section taken on the line 6—6 through the cigarette snuffer of FIG. 5;

FIG. 7, a vertical section similar to that of FIG. 6, but showing the internal parts in a different position to accommodate a shorter cigarette; and FIG. 8, a longitudinal section taken on the line 8—8 of FIG. 6.

DETAILED DESCRIPTION OF THE ILLUSTRATED EMBODIMENT

Figure 1:
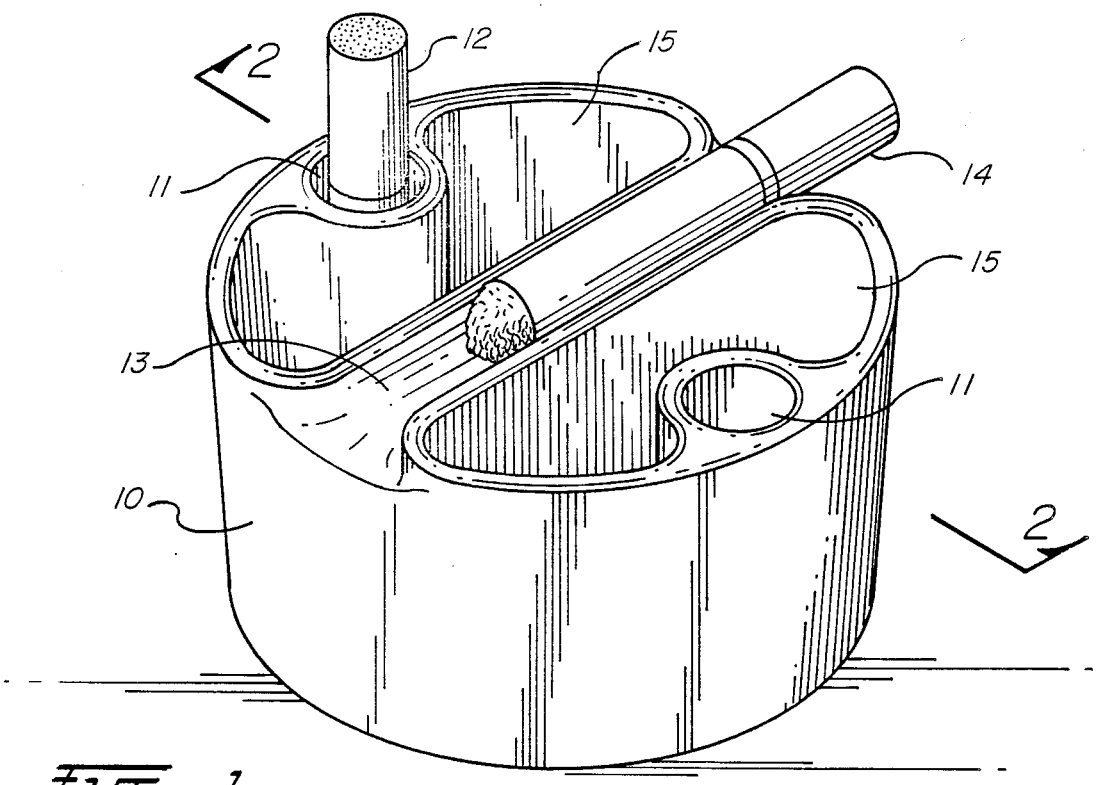
Figure 2:
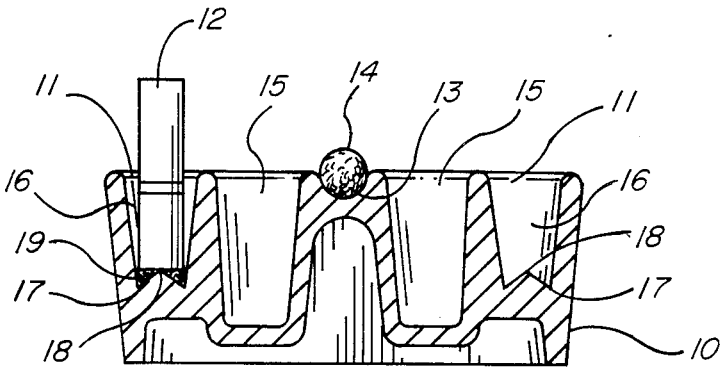

An ash tray 10 incorporating the features of the invention is shown in FIGS. 1 and 2. The ash tray is configured to include two devices of the invention, indicated generally by openings 11, for quickly extinguishing a cigarette, such as 12, but doing so in a manner to allow relighting and continued smoking of the cigarette at a later time, and one device of the invention, represented by channel 13, for allowing a cigarette, such as 14, to be rested in the ash tray and continue burning between drags thereon, but to reduce the rate of burning and smoke output of the cigarette during such periods. The ash tray 10 also includes receiving recesses 15 for receiving cigarette butts and ashes from the burning ends of cigarettes.

The devices for extinguishing a cigarette each include a passage 16 open at one end to form an opening 11, and closed at its opposite end 17 so that the passage forms a compartment open at passage opening 11. The passage 16 is sized so that it can receive a normal cigarette. The passage has stop means therein, here shown as cone 18 extending from the closed end 17 of passage 16, to stop insertion of the cigarette before it reaches the end of passage 16, as shown in the left hand passage of FIG. 2. The inside diameter of passage 16 at the stopping location of the end of the cigarette is approximately equal to the outside diameter of a normal cigarette so that the cigarette substantially fills passage 16 at the location of the end of the cigarette, i.e., the top of the cone, to form a substantially closed air chamber 19, FIG. 2, between the end of the cigarette and the end 17 of the compartment or passage 16. The end of the cigarette substantially blocks air flow about the outside of the cigarette into the closed air chamber 19 restricting any air flow into the chamber to air flowing through the cigarette itself. It has been found that when a cigarette is placed in compartment 16 against the top of cone 18 so as to form a closed air chamber 19, the cigarette will burn for several seconds and then go out. The length of time the cigarette will continue burning depends upon the size of air chamber 19, the larger the chamber, i.e., the greater the volume of air in the chamber, the longer the cigarette will burn before exhausting oxygen in the air in the chamber and going out due to lack of oxygen. A small space around the end of the cigarette does not appear to affect the performance of the device.

While merely having a flat bottom in passage 16 against which the burning end of the cigarette would abut when inserted into passage 16 would result in almost immediate extinction of the cigarette, it has been found that such extinction, as with other means of extinguishing a cigarette, if the cigarette is saved and relit for further smoking, that the cigarette tastes very badly and is unpleasant to smoke. However, it has been found that where a small air compartment is provided to supply oxygen to the end of the cigarette so that it continues to burn for several seconds, that the cigarette so extinguished can be saved and relit for additional smoking at a later time without the unpleasant taste usually accompanying a relit cigarette. It is believed that by keeping the cigarette burning for several seconds after the lighted end thereof is inserted into the closed air chamber, atmospheric air from outside the chamber actually begins to flow into the unlit end of the cigarette and is drawn toward the lighted end to cause a reverse circulation of smoke in the cigarette to thereby cleanse the filter, if there is one, and the unsmoked tobacco of smoke from the burning end of the cigarette. In many cases, satisfactory results can be achieved by sizing the air chamber to allow the cigarette to keep burning for about two seconds, however, more consistent results with various lengths of cigarettes are obtained by allowing the cigarette to continue burning for about five seconds. For a regular size cigarette which has an outside diameter of 5/16 inch, it has been found that a passage 16 tapering from an opening of ½ inch to a bottom inside diameter of 5/16 inch, with a cone extending in height for ⅛ inch operates satisfactorily and allows the cigarette to burn for about five seconds before going out.

Figure 3:
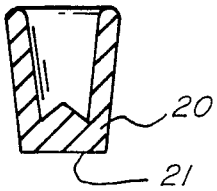

FIG. 3 shows a stand alone cigarette extinguishing device 20, having the same functional features as the device built into ash tray 10, but which may be made as an insert to be placed in a receiving hole in an ash tray or may be used alone either placed into an existing ash tray or into an automobile ash tray, or on any other surface.

Figure 4:
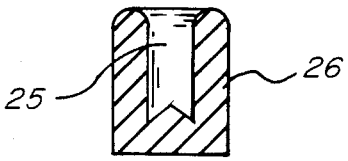

It is presently preferred that the passage or compartment be tapered as shown in FIGS. 2 and 3 so that the end of a cigarette may easily inserted thereinto and easily slides down against the top of cone 18. However, other configurations could be used. The configuration of passage 25 in device 26, FIG. 4, wherein most of the passage or compartment is cylindrical rather than tapered as in the devices of FIGS. 1 and 3, also works satisfactorily. The top of passage 25 is tapered as at 27, to guide the cigarette into passage 25.

When a smoker does not desire to extinguish his cigarette, such as when he merely wants to rest the cigarette for a minute or so between drags, the invention provides a device for slowing the burning of the cigarette between drags and reducing the amount of smoke released into the air between drags. The ash tray 10 is configured to form a base into which a channel 13 is formed. Channel 13 is configured to closely surround a portion of the circumference of a cigarette as shown in FIG. 2 wherein the channel is shown as half round to cradle one half the circumference of a cigarette placed longitudinally in the channel. With the channel so configured, as can be seen from FIG. 2, air flow is substantially restricted around one half of the end of the cigarette. This has been found to substantially slow the burning of the cigarette and substantially reduce smoke produced by the cigarette.

With the arrangement shown in FIGS. 1 and 2, it has been found that in most cases, when the burning end of a cigarette is placed in channel 13, the smoke emanating from the burning end of the cigarette is reduced about fifty percent within about the first ten seconds, and about 90% in about two minutes. The cigarette will go out if left in the channel longer than about two minutes. The time a cigarette will normally burn in the channel and after which it will go out is determined to some extent by the degree to which channel 13 surrounds the cigarette, but to be effective, it should surround at least one third of the circumference of the cigarette. It is currently preferred that it surround about one half of the circumference of the cigarette, as shown. In some instance it will be desireable to extend the sides of the channel straight upwardly more than shown to effectively cover more than one half the circumference of the cigarette, although not against the upper half circumference of the cigarette. For use with a normal cigarette having a 5/16 inch diameter, channel 13 should have a radius of about 5/16 inch. It is only necessary that the burning end of the cigarette be in channel 13 for the device to work, but it is preferred that the channel be of a length to support the cigarette therein so it does not fall out of the channel. Further, it is convenient if the unburned end of the cigarette extends outward of the channel as shown in FIG. 1 so that it can easily be picked up and removed from the channel when desired for further smoking.

Figure 5:
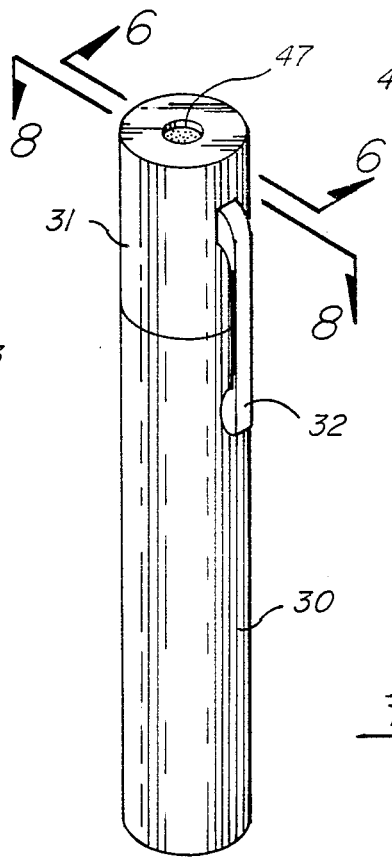

FIGS. 5–8 show an embodiment of the invention in the form of a portable cigarette snuffer. As shown in FIG. 5, the snuffer is shaped and sized similarly to a pen with a lower body 30, upper body 31 and a clip 32 for securing the snuffer in a user's pocket in normal manner as with a pen.

Figure 6:
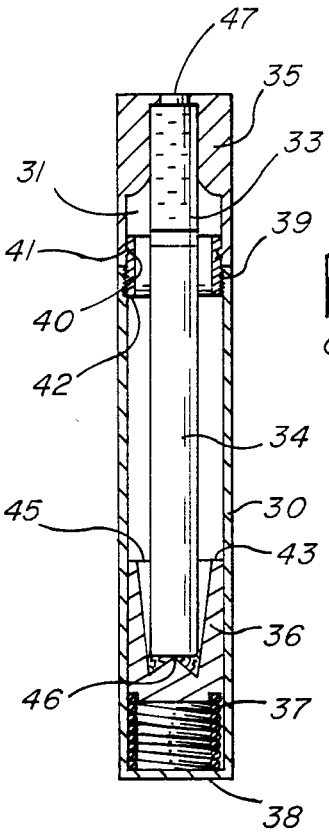
Figure 7:
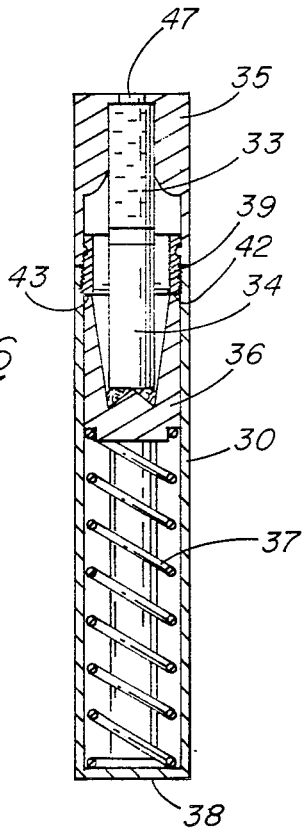
Figure 8:
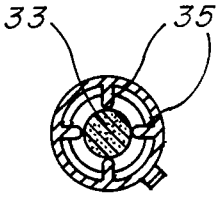

As shown in FIGS. 6–8, the upper body 31 is adapted to receive and hold the filter end of a cigarette, or the unlit end of a nonfiltered cigarette. Thus, top 31 is cylindrically open inside to receive filter 53 of cigarette 34 and has ribs 35 extending inwardly to snugly receive the end of the filter so as to hold it in top 31.

Lower body 30 is also cylindrically open inside and has a cigarette extinguishing device 36, similar to those shown in FIGS. 1–3, slidably mounted therein with a spring 37 between the bottom of the extinguishing device 36 and the closed bottom 38 of lower body 30. This spring biases the extingishing device toward the open end of lower body 30. A coupling 39 is threaded into, or otherwise secured, in the open end of lower body 30 and extends beyond the end of body 30 to provide securement means for upper body 31. Thus, as shown, coupling 39 has an annular indentation 40 which accepts an annular ridge 41 extending from the inside surface of upper body 31. In this way, upper body 31 is merely snapped in place over coupling 39 and is held in place by the mating groove and ridge. Various other forms of mating between the upper and lower bodies could be used.

Coupling 39 provides an inside shoulder 42 in lower body 30 which serves as a stop to prevent extinguishing device 36 from sliding out of the lower body after assembly. Thus, as shown in FIG. 7, the upper edge 43 of extinguishing device 36 will abut shoulder 42 at the extreme of its normal travel toward the open end of lower body 30. This will occur when no cigarette is in the snuffer, or with a very short cigarette as shown in FIG. 7. Spring 37 is chosen to urge extinguishing device 36 toward the position shown in FIG. 7, but to provide only light pressure so that the end of a cigarette in the device is not smashed.

In use, a lighted cigarette 34, FIG. 6, may be placed in upper body 31 as shown. The lighted end of the cigarette is then inserted into the lower body 30 and into the open end 45 of extinguishing device 36 until it rests on the top of spacer cone 46. As the upper body 31 is then moved toward lower body 30 and eventually the two are snapped together, cigarette 34 causes extinguishing device 36 to move toward the closed end 38 of the lower body to thereby compress spring 37. The cigarette is extinguished in the manner explained for FIGS. 1–4 so that it can be relighted and smoked at a later time. Upper body 31 is provided with an opening 47 therein aligned with the end of filter 33 to allow air to flow into filter 33 and the rest of cigarette 34 during extinguishing thereof. The extinguishing device 36 will take a position within lower body 36 somewhere between that shown in FIG. 6 and FIG. 7 which show the two extremes in cigarette length useable with the device.

While a cone stop has been shown with the device of the invention and is currently preferred as the stop to produce the closed air chamber because of its ease of manufacture and the small area of the stop that contacts the end of the cigarette, thereby leaving most of the burning end of the cigarette open to the air in the chamber, various other stop configurations could be used, such as a pin extending from the bottom of the device passage or a shoulder about the inside of the passage to abut the outer edge of a cigarette inserted thereinto. It has been found that a device sized for use with a standard cigarette also works satisfactorily with a slim cigarette. Thus, a center positioned stop is preferred since it will work with both sizes of cigarettes. A device with a smaller diameter passage is needed for a super slim cigarette.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A device for extinguishing a cigarette without damaging the physical and taste characteristics of the cigarette thereby allowing the cigarette to be relit for continued smoking, comprising an air compartment; an entrance into the air compartment adapted to allow the burning end of a cigarette to be inserted into the compartment through the entrance without physical damage to the burning end of the cigarette inserted into the compartment, the compartment being configured so that upon insertion of a cigarette thereinto, a substantially closed air chamber is formed communicating with the burning end of the cigarette with the cigarette substantially blocking flow of air into the chamber except through the cigarette itself, the chamber being sized to contain a predetermined quantity of air at the time it is closed by the end of a cigarette to allow continued burning of the cigarette for a predetermined time before the oxygen in the air in the chamber to support burning is exhausted at which time the cigarette goes out due to lack of oxygen to support further burning; and cigarette support means extending into the chamber toward the entrance thereof to contact the center of the burning end of the cigarette to space the burning end of the cigarette from the end of the chamber to allow the air in the chamber to communicate with the burning end of the cigarette.

2. A device according to claim 1, wherein the air compartment is a passage open at one end and closed at the other end and wherein the stop means stops travel of the cigarette thereinto when the tip of the cigarette is a preset distance from the closed end of the passage to create the air chamber between the tip of the cigarette and the closed end of the passage.

3. A device according to claim 2, wherein the stop means extends from the closed end of the passage toward the open end.

4. A device according to claim 3, wherein the stop means includes a cone extending from the closed end of the passage with the apex of the cone extending toward the open end of the passage to contact the center of the burning end of the cigarette.

5. A device according to claim 4, wherein the top of the passage is tapered.

6. A device according to claim 4, wherein the passage continuously tapers from a relatively wide open end to a relatively narrow closed end to ease insertion of a cigarette thereinto.

7. An ash tray, comprising a base; a receiving recess in said base for receiving ashes from a cigarette; and at least one device for extinguishing a cigarette without damaging the cigarette thereby allowing the cigarette to be relit for continued smoking, comprising an air compartment; an entrance into the air compartment adapted to allow the burning end of a cigarette to be inserted into the compartment through the entrance without physical damage to the burning end of the cigarette inserted into the compartment, the compartment being configured so that upon insertion of a cigarette thereinto, a substantially closed air chamber is formed communicating with the burning end of the cigarette with the cigarette substantially blocking flow of air into the chamber except through the cigarette itself, the chamber being sized to contain a predetermined quantity of air at the time it is closed by the end of the cigarette to allow continued burning of the cigarette for a predetermined time before the oxygen in the air in the chamber to support burning is exhausted at which time the cigarette goes out due to lack of oxygen to support further burning; and cigarette support means extending into the chamber toward the entrance thereof to contact the center of the burning end of the cigarette to space the burning end of the cigarette from the end of the chamber to allow the air in the chamber to communicate with the burning end of the cigarette.

8. An ash tray according to claim 7, wherein the air comparment is a passage open at one end and closed at the other end and wherein the stop means stops travel of the cigarette thereinto when the tip of the cigarette is a preset distance from the closed end of the passage to create the air chamber between the tip of the cigarette and the closed end of the passage.

9. An ash tray according to claim 8, wherein the stop means extends from the closed end of the passage toward the open end.

10. An ash tray according to claim 9, wherein the stop means includes a cone extending from the closed end of the passage with the apex of the cone extending toward the open end of the passage to contact the center of the burning end of the cigarette.

11. An ash tray according to claim 10, wherein the top of the passage is tapered.

12. An ash tray according to claim 10, wherein the passage continuously tapers from a relatively wide open end to a relatively narrow closed end to ease insertion of a cigarette thereinto.

13. An ash tray according to claim 7, additionally including a device for slowing the burning and smoke output of a cigarette between drags thereon by a smoker, comprising a channel formed in the base to receive the burning end portion of a cigarette therein and to support the cigarette therein, the channel being dimensioned to closely receive and craddle the portion of the cigarette received therein and to extend circumferentially around at least a third of the circumference of the cigarette.

14. An ash tray according to claim 13, wherein the channel is arcuate with a radius substantially equal to the radius of a normal cigarette and extends around approximately one half of the circumference of a received cigarette.

15. An ash tray according to claim 14, wherein the channel opens to an edge of the ash tray whereby a cigarette can be placed to rest in said channel with the burning tip of the cigarette received in said channel and with the unburned end of the cigarette extending outwardly from the channel and the ash tray.

16. An ash tray according to claim 13, wherein the channel opens to an edge of the ash tray whereby a cigarette can be placed to rest in said channel with the burning tip of the cigarette received in said channel and with the unburned end of the cigarette extending outwardly from the channel and the ash tray.

17. A device for extinguishing a cigarette having a burning end and an unlit end without damaging the physical and tast characteristics of the cigarette thereby allowing the cigarette to be relit for continued smoking, comprising an elongate member adapted to receive a cigarette therein, and open at one end to receive the burning end of a cigarette; a cap member adapted to hold the unlit end of a cigarette therein with the burning end of the cigarette extending therefrom and to close the open end of the elongate member whereby the burning end of the cigarette extending from the cap member extends into and is received by the elongate member; means within the elongate member forming an air compartment; an entrance into the air compartment adapted to allow the burning end of a cigarette inserted into the elongate member to enter the air compartment through the entrance without physical damage to the burning end of the cigarette inserted into the compartment, the compartment being configured so that upon isertion of a cigerette thereinto, a substantially closed air chamber is formed communicating with the burning end of the cigarette therein with the cigarette substantially blocking flow of air into the chamber except through the cigarette itself, the chamber being sized to contain a predetermined quantity of air at the time it is closed by the end of a cigarette to allow continued burning of the cigarette for a predetermined time before the oxygen in the air in the chamber to support burning is exhausted at which time the cigarette goes out due to lack of oxygen to support further burning; and means biasing the means forming the air compartment toward the open end of the elongate member so that the burning end of a cigarette inserted into the open end of the elongate member will enter the air compartment regardless of the distance the burning and extends into the elongate member beyond a predetermined minimum distance.

18. A device for extinguishing a cigarette according to claim 17, wherein the cap has an opening therein communicating between the unlit end of a cigarette held by the cap and the atmosphere to allow air from the atmosphere to flow into the unlit end of the cigarette.

19. A device for extinguishing a cigarette according to claim 18, wherein the means forming the air compartment forms a passage open at one end and closed at the other end and includes stop means therein to stop travel of the cigarette thereinto when the burning tip of a cigarette is a preset distance from the closed end of the passage to create the air chamber between the burning tip of the cigarette and the closed end of the passage.

20. A device for extinguishing a cigarette without damaging the physical and taste characteristics of the cigarette thereby allowing the cigarette to be relit for continued smoking, comprising a tubular passage open at one end and closed at the other end, a cone extending from the closed end of the passage with the apex of the cone extending toward the open end of the passage to form a stop for an end of a cigarette inserted into the passage, whereby the passage is configured to allow the burning end of a cigarette to be inserted into the passage through the open end thereof without physical damage to the burning end of the cigarette inserted into the passage and so that when the burning end of the cigarette inserted into the passage is stopped by the cone therein, a substantially closed air chamber is formed communicating with the burning end of the cigarette between the burning end of the cigarette and the end of the passage with the cigarette substantially blocking flow of air into the chamber except through the cigarette itself, the chamber being sized to contain a predetermined quantity of air at the time it is closed by the end of a cigarette to allow continued burning of the cigarette for a predetermined time before the oxygen in the air in the chamber to support burning is exhausted at which time the cigarette goes out due to lack of oxygen to support further burning.

* * * * *